US008251571B2

(12) United States Patent
Imai

(10) Patent No.: US 8,251,571 B2
(45) Date of Patent: Aug. 28, 2012

(54) INLINE MIXER STRUCTURE

(75) Inventor: Hiroshi Imai, Gyoda (JP)

(73) Assignee: Surpass Industry Co., Ltd., Gyoda, Saitama (JP)

( * ) Notice: Subject to any disclaimer, the term of this patent is extended or adjusted under 35 U.S.C. 154(b) by 284 days.

(21) Appl. No.: 12/599,686

(22) PCT Filed: May 15, 2008

(86) PCT No.: PCT/JP2008/058964

§ 371 (c)(1),
(2), (4) Date: Jan. 29, 2010

(87) PCT Pub. No.: WO2008/143139

PCT Pub. Date: Nov. 27, 2008

(65) Prior Publication Data

US 2010/0142312 A1 Jun. 10, 2010

(30) Foreign Application Priority Data

May 15, 2007 (JP) ..... 2007-129084

(51) Int. Cl.
*B01F 5/00* (2006.01)

(52) U.S. Cl. ..... 366/165.2; 366/165.1

(58) Field of Classification Search ..... 366/165.1–165.5
See application file for complete search history.

(56) References Cited

U.S. PATENT DOCUMENTS 1,842,877 A * 1/1932 Muller et al. ..... 366/165.4
3,219,420 A * 11/1965 Dielenberg ..... 422/145
3,794,299 A * 2/1974 Wagner et al. ..... 210/198.1
4,053,142 A * 10/1977 Johannes ..... 366/165.1

FOREIGN PATENT DOCUMENTS

JP 60-49386 4/1985
JP 05-212259 A 8/1993
JP 2007-038067 A 2/2007

* cited by examiner

*Primary Examiner* — David Sorkin
(74) *Attorney, Agent, or Firm* — Muncy, Geissler, Olds & Lowe, PLLC

(57) ABSTRACT

An inline mixer structure that is compact and has a high mixing efficiency is provided. In an inline mixer structure that forms a fluid mixture by evenly mixing and diffusing different types of fluid, a cylindrical mixer body (10) that is provided with a space portion (11) that passes therethrough in an axial direction, and a plug-shaped member (20) that is integrated by being inserted from the upstream side of the space portion (11) are provided. A chemical fluid and pure water are mixed and diffused after merging inside the space portion, where the chemical fluid is radially discharged toward a space portion (11) because the downstream end portion of a chemical fluid flow path (21) that is formed in an axial direction of the plug-shaped member (20) is closed, and pure water flows in from an eccentric fluid flow path formed so as to pass through the outer peripheral surface of the mixer body (10) at a position offset from the axial center of the space portion cross-section.

4 Claims, 4 Drawing Sheets

INLINE MIXER STRUCTURE

This application is a national stage of International Application No.: PCT/JP2008/058964, which was filed on May 15, 2008, and which claims priority to Japanese Patent Application No.: 2007-129084, which was filed in Japan on May 15, 2007, and which are both herein incorporated by reference.

TECHNICAL FIELD

The present invention relates to an inline mixer structure that forms a fluid mixture by uniformly mixing and diffusing various types of fluid.

BACKGROUND ART

Conventionally, a uniform fluid mixture is formed by mixing plural types of fluid. A mixer is known as a device that carries out such fluid mixing. One example is a static mixer in which plural stationary blades are arranged on a pipe-shaped flow path and mixing is carried out while repeatedly diffusing and blending the fluids. Because the mixing efficiency is determined, for example, by the number of times the fluid is diffused and the number of repetitions, a static mixer has been proposed that increases the mixing efficiency by using a structure in which a large amount of turbulent shear is repeatedly produced by combining, for example, back-to-back conical frames having numerous swirl vanes on the conical surfaces and cone receiving plates (for example, see Patent Document 1).

CITATION LIST

Patent Literature

Patent Document 1:
Japanese Unexamined Patent Application, Publication No. Hei 5-212259

DISCLOSURE OF INVENTION

The mixer described above is required to be compact and to increase the mixing efficiency, similar to an apparatus that produces a fluid mixture by mixing a chemical fluid and ultrapure water (DIW) in semi-conductor manufacturing apparatus equipment. In particular, as necessary, it is desirable that inline mixers that can be easily configured in parallel to attain compactness of the apparatus and high efficiency.

In consideration of the above situation, it is an object of the present invention to provide an inline mixer structure that is compact and has a high mixing efficiency.

The present invention uses the following solutions to solve these problems.

In an inline mixer structure that forms a fluid mixture by evenly mixing and diffusing different types of fluid, one aspect of the present invention includes a cylindrical mixer body that is provided with a space portion that passes therethrough in an axial direction and a plug-shaped member that is integrated by being inserted from the upstream side of the space portion. A fluid, which is discharged radially toward a space portion because the downstream side end portion of an inside flow path formed in an axial direction of the plug-shaped member is closed, and a fluid, which flows in from an eccentric fluid flow path formed so as to pass through the outer peripheral surface of the mixer body at a position that is offset from the axial center of the space portion cross-section, are mixed and diffused after merging inside the space portion.

According to such an inline mixture structure, a cylindrical mixer body that is provided with a space portion that passes therethrough in an axial direction and a plug-shaped member that is integrated by being inserted from the upstream side of the space portion are provided. A fluid, which is discharged radially toward a space portion because the downstream side end portion of an inside flow path formed in an axial direction of the plug-shaped member is closed, and a fluid, which flows in from an eccentric fluid flow path formed so as to pass through the outer peripheral surface of the mixer body at a position that is offset from the axial center of the space portion cross-section, are mixed and diffused after merging inside the space portion. Thus, the fluid that is discharged radially from the plug shaped portion toward the inner peripheral surface of the mixer body and the fluid that flows from the eccentric fluid flow path of the mixer body into the space portion merge so as to impinge. At this time, the fluid that flows in from the eccentric fluid flow path forms a swirling fluid that swirls along the inner wall surface of the space portion because the flow path direction is offset from the axial center of the space portion cross-section.

In the inline mixer structure described above, preferably the fluid outlet of the eccentric fluid flow path opens at a position that forms a clearance space between the fluid outlet of the eccentric fluid flow path and the discharge outlets that radially discharge a fluid from the plug-shaped member. Thereby, the fluid (radiating fluid) that is radially discharged into the comparatively narrow clearance space and the fluid (swirling fluid) that forms a swirling flow merge by impinging such that flows are disrupted at the adjacent position, and thus, the two flows can mix and diffuse with high efficiency to form a fluid mixture.

In the inline mixer structure described above, preferably downstream of the position at which the fluids merge together inside the space portion, baffle plates that project from the inner wall surface are provided so as to be arranged in a peripheral direction, and thereby, the fluid mixture can be further agitated.

In the inline mixture structure described above, preferably a plate that closes the space portion is provided downstream of the baffle plates, and opening portions, which are cut out of an outer peripheral portion from the baffle plates such that their positions are offset in the peripheral direction, are provided in the plate. Thereby, because the opening portion serves as a discharge path for the fluid mixture, a more thorough agitation is promoted because a flow in which the fluid mixture is conducted in a radial direction is formed.

A more thorough agitation can be promoted by disposing plural baffle plates and the opening portion described above at a uniform pitch in a peripheral direction.

In the inline mixer structure described above, at the outlet end side of the space portion, preferably a pooling space for the fluid mixture is provided at the outer peripheral portion of the outlet opening through which the fluid mixture is discharged, and thus, because the flow that has pooled at the outer peripheral portion at one end of the outlet opening is discharged from the outlet opening, which is at the center portion of the outlet side end portion, the agitation efficiency can be further improved.

According to the present invention describe above, the radiating fluid that is radially discharged from the plug-shaped member and the swirling fluid that forms a swirling flow after flowing out from the eccentric fluid flow path of the mixer body are mixed and diffused after merging by impinging inside the space portion, and thus, an advantageous mixing efficiency can be attained. There are no moving parts for forming the fluid mixture by causing the radiating fluid and the swirling fluid to impinge. Therefore, an inline mixer that is compact and is superior in terms of reliability and duration can be obtained.

A more thoroughly advantageous mixture efficiency can be attained because the agitation efficiency is improved due to the structure in which a radiating fluid and a swirling fluid impinge in a comparatively narrow clearance space, the disposition of baffle plates and a plate having opening portions cut therein, and furthermore, the disposition of a pooling space.

BEST MODE FOR CARRYING OUT THE INVENTION

An embodiment of the inline mixer structure according to the present invention will be explained with reference to the figures.

Figure 1A:
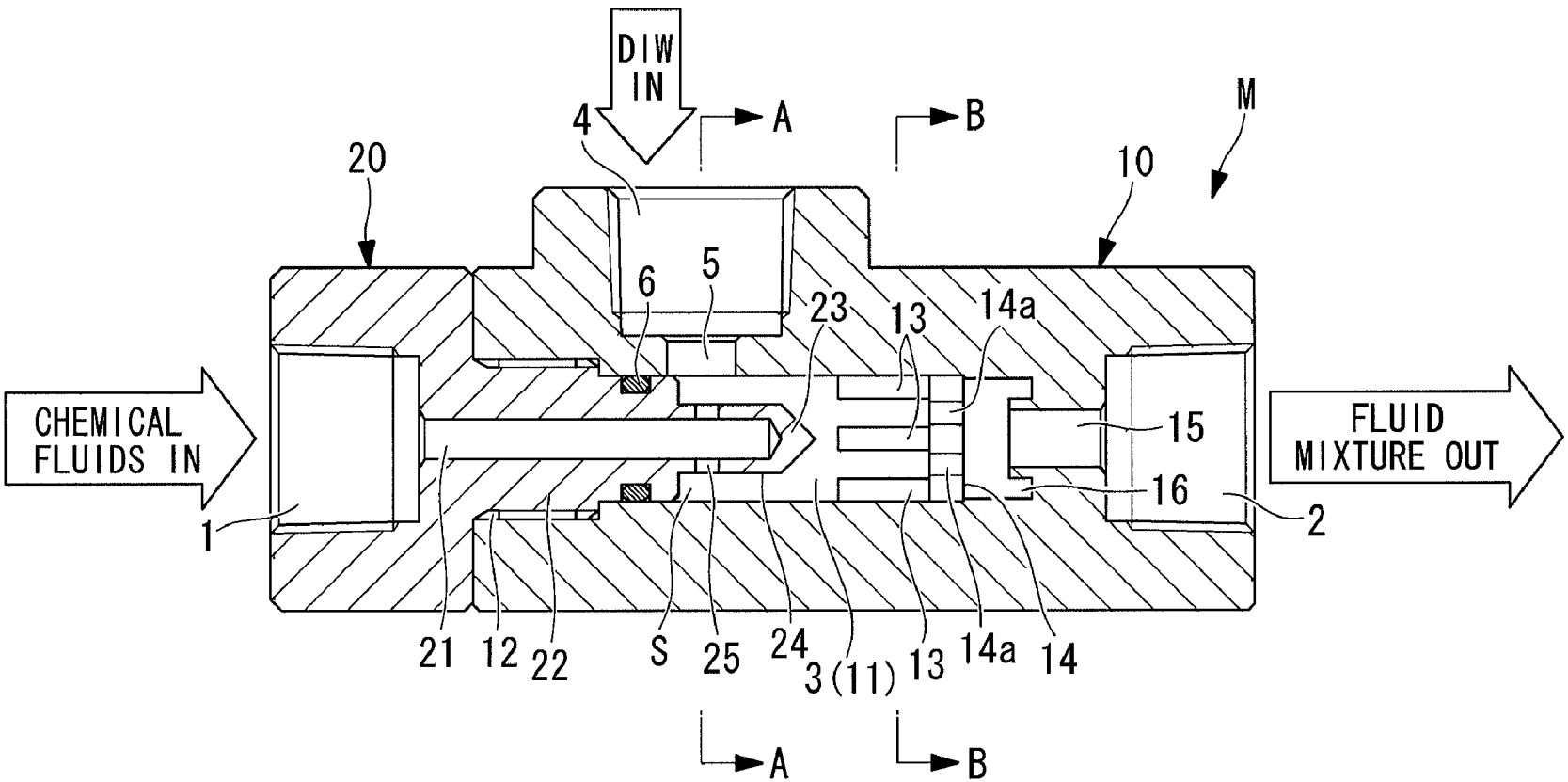
FIG. 1A is a cross-sectional view that shows an embodiment of the inline mixer structure according to the present invention.
Figure 1B:
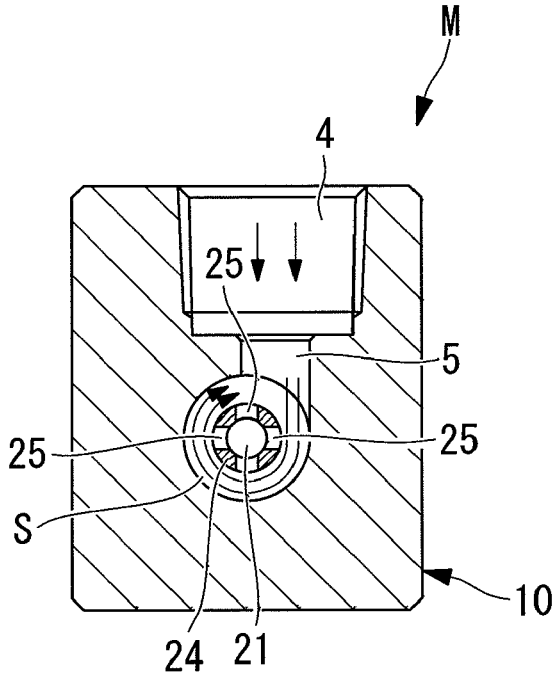
FIG. 1B is a cross-sectional view along line A-A in FIG. 1A.
Figure 4:
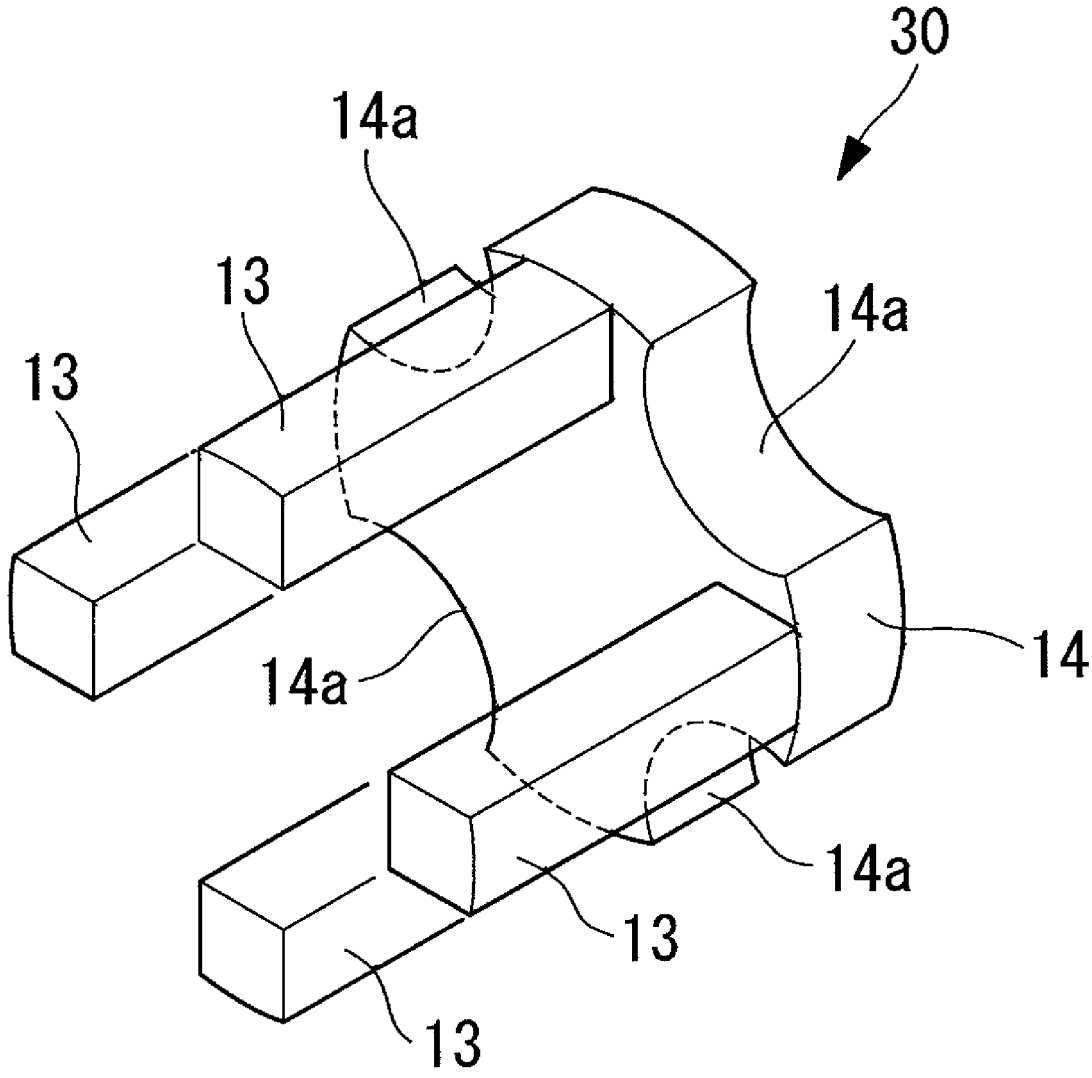
FIG. 4 is a perspective view showing the outline of the plate equipped with baffle plates.

The inline mixer M that is shown in FIG. 1A, FIG. 1B, and FIG. 4 is an apparatus that forms a fluid mixture by uniformly mixing and diffusing two types of fluid such as a chemical fluid and ultrapure water (DIW). This inline mixer M is provided with a chemical fluid inlet 1 and a fluid mixture outlet 2, each of which opens at opposite ends thereof in an axial direction, and an pure water inlet 4 that is provided so as to intersect the fluid path 3 that communicates the chemical fluid outlet 1 and the fluid mixture outlet 2, which communicate in an axial direction. The chemical fluid inlet 1, the fluid mixture outlet 2, and the pure water outlet 4 are all female pipe connecting openings in which an internal threading has been cut.

The inline mixer M described above is formed by integrally combining the mixer body 10 and the plug-shaped member 20. In consideration of contact with the chemical fluid, the mixture body 10 and the plug member 20 that are used here preferably employ, for example, fluorocarbon resin molded components that have superior chemical resistance.

The mixer body 10 is a tubular member that is provided with a space portion 11 that passes therethrough in an axial direction (the direction horizontal to the page), and this space portion 11 serves as a fluid path 3 for the inline mixer M. In the space portion 11, which has a circular cross-section, a plug coupling opening 12, into which the plug member 20, described below, is threaded, is provided to serve as one end side opening on the upstream side. An inner screw that is used for threading the plug member 20 is formed in this plug coupling opening 12.

A fluid mixture discharge outlet 2, which discharges the fluid mixture that results from mixing and diffusing two types of fluid, is provided to serve as the other end side opening that is downstream of the space portion 11. Internal threading for pipe connections is also formed in this fluid mixture discharge outlet 2.

The pure water inlet 4, which opens to communicate in the upward direction of the page, is provided so as to intersect in a horizontal direction in the space portion 11, and internal threading to be connected to pipes is also formed in this pure water inlet 4. In addition, as shown in FIG. 1B, the pure water flow path 5, which communicates the pure water inlet 4 and the flow path 3, is provided at a position that is offset from the axis of the flow path 3.

That is, in the cross-sectional shape of the space portion 11, the pure water flow path 5 is an eccentric fluid flow path that is formed so as to pass through the outer peripheral surface of this mixer body 10 at a position that is offset from the axial center of the circular cross-section, and the axis of the pure water flow path 5 and the axis of the space portion 11, which serves as the flow path 3, are eccentrically disposed so as not to intersect each other.

In the illustrated example, the outer peripheral side wall surface of the pure water flow path 5 is offset so as to substantially align with a line tangent to the flow path 3, which has a circular cross-section. In other words, in the example of the configuration in FIG. 1B, the axis of the pure water flow path 5 is offset from the axis of the flow path 3 toward the right side of the page.

The plug-shaped member 20 is a cylindrical member that has diameters that differ at plural steps. An opening serving as a chemical fluid inlet 1 is formed on one end side that has a maximum diameter on the upstream side of the plug-shaped member 20. This chemical fluid inlet 1 communicates with the chemical fluid flow path 21, which is the inside flow path that is formed through the axial center of the plug-shaped member 20 toward the downstream side. This chemical fluid flow path 21 is inserted inside the space portion 11 of the mixer body 10 from the plug coupling opening 12, passes through the plug portion 22, which has diameters that decrease stepwise, and the distal end thereof on the downstream side is closed by the closing portion 23. A distal end small diameter portion 24, which has a diameter that is smaller than the inner diameter of the space portion 11, is provided on the downstream side of the plug portion 22.

That is, while the plug portion 22 is threaded into the space portion 11 and integrated therewith, a clearance space S, having a clearance dimension which is comparatively narrow in comparison to the cross section of the flow path 3, is formed between the outer peripheral surface of the distal end small diameter portion 24 and the inner wall surface of the space portion 11. In the figure, reference numeral 6 is a sealing O-ring that prevents fluid from flowing out toward the upstream side of the space portion 11 in the mating portion between the mixer body 10 and the plug member 20 after both have been threaded together and integrated.

The chemical fluid flow path 21 described above has imparted thereto a rectilinear shape from the chemical fluid inlet 1 to the closing portion 23 that is provided at the distal end small diameter portion 24, and the chemical fluid outlets 25 are provided so as to open in the outer peripheral side of the distal end small diameter portion 24, which is slightly more toward the upstream side than the closing portion 23. As shown, for example, by the cross-section A-A in FIG. 1A, preferably these chemical fluid outlets 25 open at a position that aligns so as to have a cross-section identical to the pure water flow path 5, and by providing plural chemical fluid outlets 25 at a uniform pitch on the outer periphery of the distal end small diameter portion 24, the chemical fluid that has flowed into the chemical fluid flow path 21 flows out radially from the chemical fluid outlets 25 into the space portion 11. In the illustrated example, four chemical fluid outlets 25 are disposed at a 90° pitch, but this is not limiting.

When the inline mixer M structured in this manner is integrated by threading the plug-shaped member 20 into the plug coupling opening 12 of the mixer body 10, the flow path 3 and the chemical fluid flow path 21 are coaxially positioned. In addition, chemical fluid is supplied from the chemical fluid inlet 1, and at the same time, when pure water is supplied from the pure water inlet 4, two types of fluid are mixed and diffused in the manner to be explained below.

The chemical fluid that has been introduced from the chemical fluid inlet 1 flows through the chemical fluid flow path 21, and is radially discharged from the chemical fluid outlets 25, which open in proximity to the distal end portion, toward the clearance space S.

In contrast, the pure water that has been introduced from the pure water inlet 4 flows through the pure water flow path 5 to the fluid flow path 3, and then flows in toward the clearance space S. At this time, because the pure water flow path 5 has an eccentric fluid flow path that is offset from the axis of the space portion 11 that serves as a flow path 3, the pure water that has flowed into circular cross-sectional surface space portion 11 has imparted thereto a swirling flow that flows along the inner wall surface of the space portion 11.

Therefore, in the narrow clearance space S, the chemical fluid, which is a radiating fluid that is radially discharged, and the pure water, which is a swirling fluid that forms a swirling flow, are merged and impinge. Thus, both flows form a merged flow after being efficiently mixed and diffused. In particular, because the pure water flow path 5 is offset, if the outer peripheral side wall surface of the pure water flow path 5 substantially aligns with a line tangent to the space portion 11 having a circular cross-section, it is possible to more efficiently produce a large swirling flow that swirls along the inner wall surface of the space portion 11.

Because the radiating fluid and the swirling fluid are made to impinge in a comparatively narrow space such as the clearance space S, the two fluids merge while vigorously impinging such that their flows are disrupted at the adjacent positions. Thus, the two flows of the radiating fluid and the swirling fluid form a merged fluid that has been very efficiently mixed and diffused.

The fluid mixture that has been formed in this manner flows toward the downstream side through the flow path 3 of the space portion 11, and is discharged to a pipe (not illustrated) from the fluid mixture outlet 3.

In this connection, preferably, the merging location for the radiating fluid and the swirling fluid that is advantageous for carrying out mixing and diffusing with high efficiency is a comparatively narrow space, similar to the clearance space S described above, and both fluids merge so as to directly impinge with a substantially identical cross-sectional surface. However, although disadvantageous in terms of the efficiency of the merging and diffusing, various modifications are possible depending on the objective and characteristics of the flow. For example, both fluids may merge after being discharged at a position offset in the axial direction of the space portion 11, or both fluids may merge inside the space portion 11 that is farther downstream than the clearance space S.

In the space portion 11 described above, preferably, after the chemical fluid, which is a radiating fluid, and the ultrapure water, which is a swirling fluid, have been mixed and diffused after merging, baffle plates 13 are provided so as to be arranged in a peripheral direction in the downstream flow path 3, in which the fluid mixture flows toward the fluid mixture outlet 4. These baffle plates 13 are members that project from the inner wall surface of the space portion 13 toward the inside thereof, and in the illustrated example, are provided at four locations at a pitch of 90° in the peripheral direction. In particular, the action of perturbing and agitating the swirling flow of the fluid mixture is obtained. Therefore, a more thorough mixing and diffusing is promoted by the fluid mixture being further agitated.

Figure 2:
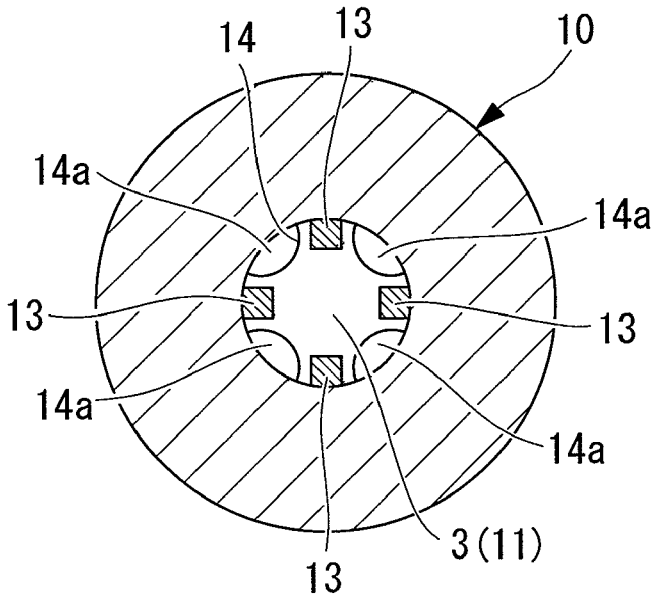
FIG. 2 is a cross-sectional view along line B-B in FIG. 1A.
Figure 3:
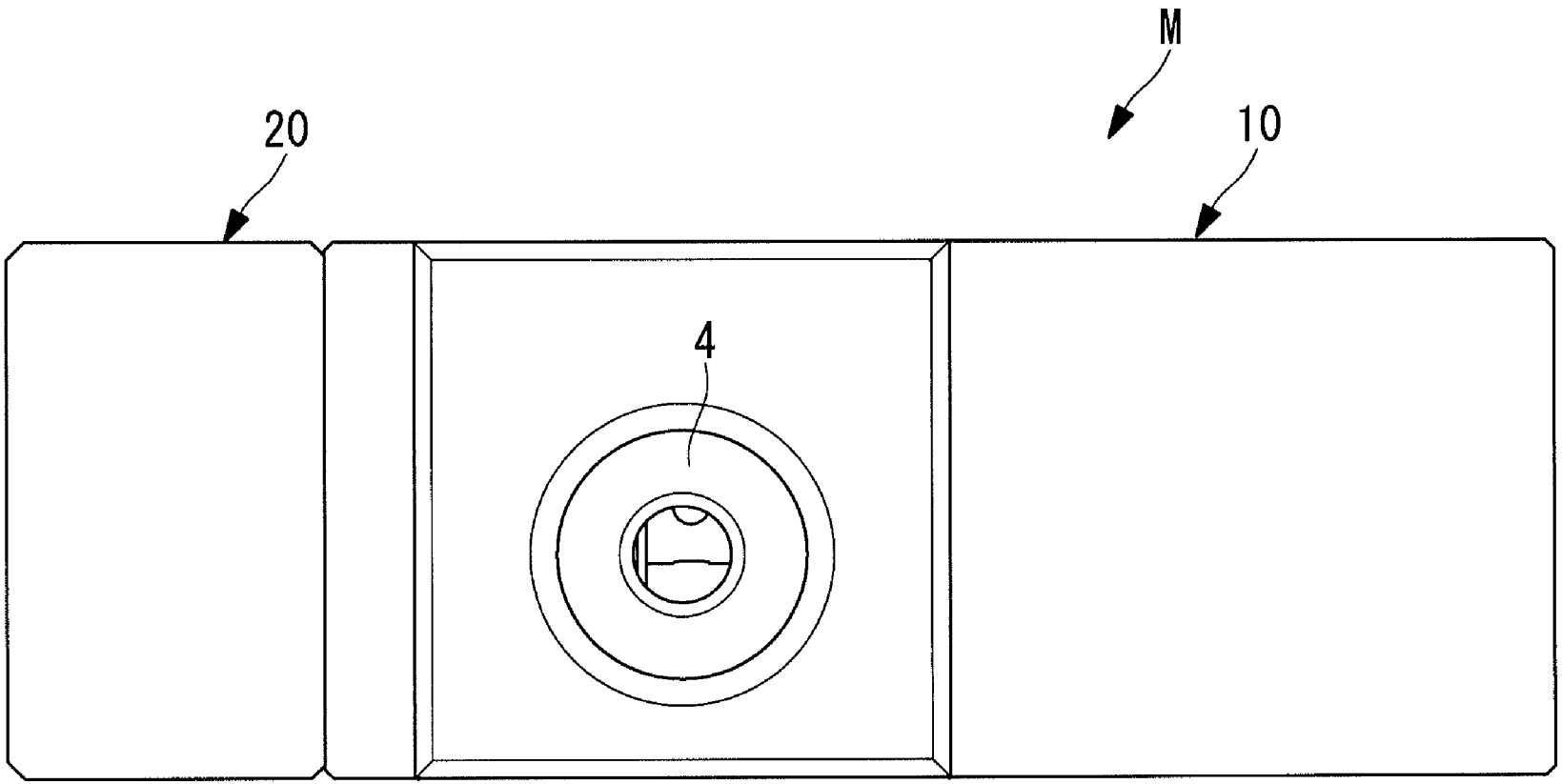
FIG. 3 is a plan view of the inline mixer structure shown in FIG. 1A.

A plate 14 is provided downstream of the baffle plates 13 described above so as to block the axial flow in the space portion 11. Opening portions 14*a* that are small in comparison to the cross-sectional flow area of the space portion 11 are provided in these plates 14. The opening portions 14*a* are outlet flow paths for the fluid mixture that are provided by cutting out the outer peripheral portion of the plates 14, and are disposed so as to be offset from the position of the above-described baffle plates 13 in a peripheral direction. That is, in the illustrated example, as shown in FIG. 2, the opening portions 14*a* are disposed at four locations at a 90° pitch in a peripheral direction at positions offset by 45° so as to be positioned between the baffle plates 13 that are provided at four locations at a 90° pitch. Therefore, the baffle plates 13 and the opening portions 14*a* are disposed alternately at a 45° pitch in the peripheral direction of a space portion 11.

By using such a structure, because the swirling flow is disrupted by the baffle plates 13 and the flow of the fluid mixture in the forward direction is blocked by the plate 14, the flow direction toward the opening portions 14*a*, which serve as the outlet flow paths for the fluid mixture, must be altered. Thus, because a flow that conducts the fluid mixture in a radial direction is formed, the efficiency of the mixing and diffusing is increased by promoting a more thorough agitation. Here, although use of the plate 14 in combination with baffle plates 13 was explained, the fluid mixture can form a flow that is conducted in a radial direction to promote agitation even if only the plates having cutout opening portions 14*a* are used.

The baffle plates 13 and the plates 14 described above may be installed independently, or may be provided after being integrally formed with the mixer body 10. However, an integrally molded component such as the one that is shown, for example, in FIG. 5 may be used.

A plate 30 with baffle plates, shown in FIG. 4, is a molded resin component in which the baffle plates 13 project from one surface of the plate 14 having opening portions 14*a* cut therein. If such a separate component is used, the separate component can be inserted into the space portion 11 of the mixer body 10, attached at a desired position, and used as the baffle plates 13 and the plate 14.

Furthermore, on the outlet end side of the space portion 11, that is, in proximity to the upstream side of the fluid mixture outlet 2 in the space portion 11, as shown, for example, in FIG. 1A, preferably a concave portion 16, which serves as a pooling space for the fluid mixture, is arranged on the outer peripheral portion of the outlet opening 15 that discharges the fluid mixture. This concave portion 16 is a ring-shaped concave space formed on the outer peripheral side wall surface of the outlet opening 15 that narrows the inner diameter of the space portion 11, and the flow of the fluid mixture towards the fluid mixture outlet 2 exits from the outlet opening 15, which opens in the center portion after at least a portion thereof has pooled at the end concave portion 16. Thus, because turbulence is created in the flow of the fluid mixture, and the fluid mixture flows out at the fluid mixture outlet 2 from the outlet opening 15 after being more thoroughly agitated, an improvement in the agitation effect can be expected.

According to the inline mixer structure of the present invention, a radiating fluid (chemical fluid), which flows radially out from the chemical fluid outlets 25 of the plug-shaped member 20, and the swirling fluid (ultrapure water), which forms a swirling flow after flowing out from the eccentric fluid flow path such as the pure water flow path 5 that is formed in the mixture body 10, are mixed and diffused by merging so as to impinge inside the space portion 11, and thus, an advantageous mixing efficiency can be obtained. There are no moving parts because a fluid mixture is formed by causing impingement between a radial fluid and a swirling fluid, and therefore, an inline mixer M that is compact and is superior in terms of reliability and durability can be produced.

The agitation efficiency is increased due to a structure that causes a radial fluid and a swirling fluid to impinge in a comparatively narrow space, the arrangement of baffle plates 13 and plates 14 having opening portions 14*a* cut therein, and furthermore, the arrangement of a concave portion 16 that serves as a pooling space, and thus, a significantly more advantageous mixing efficiency can be obtained.

In this connection, in the embodiment described above, an inline mixer M in which a chemical fluid and ultrapure water are mixed and diffused to produce a fluid mixture was explained. However, the present invention is not limited thereby. The present invention can be applied not only to mixing and diffusing other fluids, but also to mixing gasses and particles.

The fluid to be mixed is not limited to two types, but, for example, by serially linking inline mixers M described above, three or more types of fluid can be mixed and diffused. The number of fluids to be mixed may be increased by providing plural similarly offset fluid supply paths that corresponds to the pure water inlet 4 and the pure water flow path 5 that are provided in the mixer body 10 so as to be offset.

The present invention is not limited to the embodiment described above, and suitable modifications thereof are possible within a range that does not depart from the spirit of the present invention.

REFERENCE SIGNS LIST

1: chemical fluid inlet
2: fluid mixture outlet
3: flow path
4: pure water inlet
5: pure water flow path
10: mixer body
11: space portion
13: baffle plate
14: plate
14*a*: opening portion
15: outlet flow path
16: concave portion
20: plug-shaped member
21: chemical fluid flow path
22: plug portion
23: closing portion
24: distal end small diameter portion
25: chemical fluid outlet
30: baffle plate equipped plate
M: inline mixer
S: clearance space

The invention claimed is:

1. An inline mixer structure that forms a fluid mixture by evenly mixing and diffusing different types of fluid, comprising:

a cylindrical mixer body that is provided with a space portion that passes therethrough in an axial direction; and a plug-shaped member that is integrated by being inserted from the upstream side of the space portion;

a plurality of baffle plates that project from an inner wall surface of the space portion;

wherein a fluid, which is discharges radially toward the space portion because the downstream side end portion of an inside flow path that is formed in an axial direction of the plug-shaped member is closed, and a fluid, which flows in from an eccentric fluid flow path that is formed so as to pass through the outer peripheral surface of the mixer body at a position that is offset from the axial center of the space portion cross-section, are mixed and diffused after merging inside the space portion; and wherein the plurality of baffle plates are provided so as to be arranged in a peripheral direction downstream of the position at which the fluids merge together inside the space portion.

2. An inline mixer structure according to claim 1, wherein a second discharge outlet of the eccentric fluid flow path opens at a position where a clearance space is formed between a first discharge outlet that radially discharges a fluid from the plug-shaped member and the second discharge outlet of the eccentric fluid flow path.

3. An inline mixer structure according to claim 1, wherein a plate that closes the space portion is provided downstream of the plurality of baffle plates, and opening portions that are cut out of an outer peripheral portion at a position offset toward the peripheral direction from the baffle plates are provided on the plate.

4. An inline mixer structure according to claim 1, wherein a pooling space for the fluid mixture is provided at the outer peripheral portion of an outlet opening through which the fluid mixture is discharged at the outlet end portion side of the space portion.

* * * * *